US009324220B2

(12) United States Patent
Valiulis

(10) Patent No.: US 9,324,220 B2
(45) **Date of Patent: *Apr. 26, 2016**

(54) THEFT DETECTION DEVICE AND METHOD FOR CONTROLLING SAME

(71) Applicant: Thomas E. Valiulis, Rockford, IL (US)

(72) Inventor: Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 95 days.

This patent is subject to a terminal disclaimer.

(21) Appl. No.: 14/205,611

(22) Filed: Mar. 12, 2014

(65) Prior Publication Data

US 2014/0191870 A1 Jul. 10, 2014

Related U.S. Application Data

(63) Continuation-in-part of application No. 13/591,023, filed on Aug. 21, 2012, now Pat. No. 8,884,761.

(51) Int. Cl.
*G08B 13/24* (2006.01)

(52) U.S. Cl.
CPC ..... *G08B 13/2434* (2013.01); *G08B 13/2448* (2013.01); *G08B 13/2482* (2013.01)

(58) Field of Classification Search
USPC ..... 340/539.1, 568.1, 10.1, 309.9, 426.31, 340/429, 514, 515, 539.13, 539.26, 539.3, 340/571, 572.1, 573.1, 573.4, 628, 636.1, 340/686.1
See application file for complete search history.

(56) References Cited

U.S. PATENT DOCUMENTS

| | | | | |
|---|---|---|---|---|
| 4,383,242 | A | 5/1983 | Sassover et al. | |
| 4,462,023 | A | 7/1984 | Nielsen et al. | |
| 4,996,515 | A * | 2/1991 | Schaffer | B60R 25/10 307/10.2 |
| 5,068,643 | A | 11/1991 | Yashina | |
| 5,086,641 | A * | 2/1992 | Roselli | G01D 18/008 250/231.18 |
| 5,168,263 | A | 12/1992 | Drucker | |
| 5,317,304 | A | 5/1994 | Choi | |
| 5,434,559 | A | 7/1995 | Smiley et al. | |
| 5,469,135 | A * | 11/1995 | Solow | B60R 25/0225 307/10.2 |

(Continued)

FOREIGN PATENT DOCUMENTS

| | | | |
|---|---|---|---|
| DE | 102011012163 | A1 | 8/2012 |
| KR | 100823026 | B1 | 4/2008 |

(Continued)

OTHER PUBLICATIONS

U.S. Appl. No. 14/215,538, filed Mar. 17, 2014, Valiulis et al.

(Continued)

*Primary Examiner* — Fekadeselassie Girma
(74) *Attorney, Agent, or Firm* — Reinhart Boerner Van Deuren P.C.

(57) ABSTRACT

A theft detection device, configured to be coupled to a product, includes a light sensor, a motion sensor, an emitter configured to emit a signal, and a controller coupled to the light sensor, the motion sensor, and the emitter. The controller is configured to determine a light level sensed by the light sensor. The controller is also configured to determine, via the motion sensor, whether the theft detection device is in motion. Further, the controller is configured to operate the emitter based on the sensed motion of the theft detection device and the light level sensed by the light sensor. The controller is further configured to deactivate the theft protection device when the light sensor detects a coded light sequence.

15 Claims, 8 Drawing Sheets

(56) References Cited

U.S. PATENT DOCUMENTS 5,570,080 A 10/1996 Inoue et al.
5,757,270 A 5/1998 Mori
5,815,066 A * 9/1998 Pumilia ..... G08B 29/145 340/309.9
5,838,225 A 11/1998 Todd
5,905,438 A * 5/1999 Weiss ..... G08B 29/181 340/539.1
5,955,951 A 9/1999 Wischerop et al.
5,965,954 A * 10/1999 Johnson ..... B60R 25/04 180/287
5,977,654 A * 11/1999 Johnson ..... B60R 25/04 180/287
5,979,674 A 11/1999 Thalenfeld
6,049,268 A 4/2000 Flick
6,133,830 A 10/2000 D'Angelo et al.
6,373,381 B2 4/2002 Wu
6,517,000 B1 2/2003 McAllister et al.
6,628,344 B1 * 9/2003 Weber ..... G08C 23/04 348/734
6,690,411 B2 2/2004 Naidoo et al.
6,967,578 B1 11/2005 Guida
7,174,176 B1 * 2/2007 Liu ..... H04W 88/02 455/404.1
7,210,164 B1 * 4/2007 Jandrell ..... G06F 21/305 713/192
7,258,461 B1 * 8/2007 Izardel ..... E01F 13/04 362/152
7,530,188 B2 5/2009 Beilenhoff et al.
7,584,930 B2 9/2009 Zich
7,591,422 B2 9/2009 Maitin
7,671,741 B2 3/2010 Lax et al.
7,671,742 B2 3/2010 Fallin et al.
7,768,399 B2 8/2010 Hachmann et al.
7,969,305 B2 6/2011 Belden, Jr. et al.
8,103,047 B1 * 1/2012 Griess ..... H04L 67/12 340/572.1
8,139,945 B1 * 3/2012 Amir ..... H04B 10/1149 340/8.1
8,274,391 B2 9/2012 Yang
8,378,826 B2 2/2013 Mercier et al.
8,534,469 B2 9/2013 Northrup, Jr. et al.
8,629,772 B2 1/2014 Valiulis et al.
9,009,773 B1 * 4/2015 Hendricks ..... H04N 21/4104 725/100
2002/0067259 A1 6/2002 Fufidio et al.
2002/0130776 A1 9/2002 Houde
2002/0188866 A1 * 12/2002 Ca ..... G06F 21/88 726/4
2003/0030548 A1 2/2003 Kovacs et al.
2003/0175004 A1 9/2003 Garito et al.
2003/0227382 A1 * 12/2003 Breed ..... G06Q 20/203 340/539.13
2004/0145477 A1 7/2004 Easter et al.
2005/0104733 A1 5/2005 Campero
2005/0261816 A1 * 11/2005 DiCroce ..... B60R 25/00 701/36
2006/0198611 A1 9/2006 Park
2007/0115100 A1 * 5/2007 Mandle ..... B60R 25/04 340/426.11
2007/0171059 A1 * 7/2007 Pistilli ..... G06F 21/85 340/568.1
2009/0095695 A1 4/2009 Moock et al.
2009/0109027 A1 4/2009 Schuller
2009/0308494 A1 * 12/2009 Linn ..... B67D 1/0014 141/391
2010/0097223 A1 4/2010 Kruest et al.
2010/0175438 A1 7/2010 Sankey
2010/0238031 A1 9/2010 Belden, Jr. et al.
2011/0062794 A1 * 3/2011 Vergoossen ..... H04L 12/12 307/125
2011/0068921 A1 * 3/2011 Shafer ..... G06K 7/0008 340/571
2011/0215060 A1 9/2011 Niederhuefner
2011/0227735 A1 9/2011 Fawcett et al.
2011/0310307 A1 * 12/2011 Takahashi ..... H03G 1/02 348/734
2012/0287090 A1 * 11/2012 Cacioppo ..... G06F 3/0433 345/179
2013/0057524 A1 * 3/2013 Bertin ..... H04N 5/44582 345/204
2013/0142494 A1 6/2013 Valiulis et al.
2014/0055264 A1 2/2014 Valiulis et al.
2014/0070948 A1 3/2014 Valiulis et al.
2015/0042178 A1 * 2/2015 Kim ..... H02J 13/00 307/117

FOREIGN PATENT DOCUMENTS

KR 20100137956 A 12/2010
KR 2020110002261 U 3/2011
KR 20110043837 A 4/2011
KR 20110080411 A 7/2011
WO WO 01/81988 A2 11/2001
WO 2009/100857 A1 8/2009
WO WO 2011/025085 A1 3/2011
WO 2012/113536 A1 8/2012

OTHER PUBLICATIONS

Indyme smartresponse; 2 pages printed from internet http://www.indyme.com/; date last visited Apr. 8, 2013.

* cited by examiner

THEFT DETECTION DEVICE AND METHOD FOR CONTROLLING SAME

CROSS-REFERENCE TO RELATED PATENT APPLICATIONS

This patent application is a Continuation-in-Part of co-pending U.S. patent application Ser. No. 13/591,023, filed Aug. 21, 2012, the entire teachings and disclosure of which are incorporated herein by reference thereto.

FIELD OF THE INVENTION

This invention generally relates to retail systems, and, more particularly, to theft detection systems for use in a retail environment.

BACKGROUND OF THE INVENTION

The retail industry looks to prevent loss due to theft. Therefore, many retail environments include theft deterrence systems. Some retail environments may provide an electronic article surveillance (EAS) system in which gates may be located proximate the exit to the retail environment. In such a system, a tag may be placed on merchandise, and if an EAS gate senses a tag passing through it, it sounds an alarm. Thus, the alarm is typically sounded only as the thief and the stolen merchandise are already leaving the retail environment.

BRIEF SUMMARY OF THE INVENTION

In one aspect, embodiments of the invention provide a theft detection device, configured to be coupled to a product, includes a light sensor, a motion sensor, an emitter configured to emit a signal, and a controller coupled to the light sensor, the motion sensor, and the emitter. The controller is configured to determine a light level sensed by the light sensor. The controller is also configured to determine, via the motion sensor, whether the theft detection device is in motion. Further, the controller is configured to operate the emitter based on the sensed motion of the theft detection device and the light level sensed by the light sensor. The controller is further configured to deactivate the theft protection device when the light sensor detects a coded light sequence.

In a particular embodiment, the controller is configured to recognize strobe light sequences received by the light sensor. The theft detection device may also include a handheld strobe device for activating and deactivating the theft protection device. The controller may also be configured to deactivate the theft protection device for a predetermined period of time when the light sensor detects the coded light sequence. The controller may be further configured to keep the theft protection device deactivated if the theft protection device is decoupled from the product during the predetermined period of time.

In certain embodiments, the controller is configured to re-activate the theft protection device if the theft protection device is subsequently coupled to a product. The controller may be configured to re-activate the theft protection device if the theft protection device is not decoupled from the product. The controller may be further configured to recognize multiple coded light sequences for deactivation of the theft detection device.

In another aspect, embodiments of the invention provide a theft detection device, configured to be coupled to a product, which includes a light sensor, a motion sensor, an emitter configured to emit a signal, and a controller coupled to the light sensor, the motion sensor, and the emitter. The controller is configured to determine a light level sensed by the light sensor. The controller is also configured to determine, via the motion sensor, whether the theft detection device is in motion. The controller is further configured to operate the emitter based on the sensed motion of the theft detection device and the light level sensed by the light sensor. Furthermore, the controller is configured to enter the theft detection device into a sleep mode when no motion is detected for a predetermined period of time.

In a particular embodiment, the controller is configured to enter the theft detection device into the sleep mode when no motion is detected for 30 seconds. In a more particular embodiment of the invention, after entering sleep mode, the controller is configured to exit the theft detection device from the sleep mode when the motion sensor detects motion for at least three consecutive seconds. In some embodiments, after exiting sleep mode, if the light sensed by the light sensor is below a threshold level, the controller is configured to cause the emitter to emit an alarm signal after a countdown period. In particular embodiments, after exiting sleep mode, if no movement is detected for a predetermined time period, the controller enters theft detection device into the sleep mode.

In yet another aspect, embodiments of the invention provide a theft detection device configured to be coupled to a product. The theft detection device includes a light sensor, a motion sensor, an emitter configured to emit a signal, and a controller coupled to the light sensor, the motion sensor, and the emitter. The controller is configured to determine a light level sensed by the light sensor, and configured to determine, via the motion sensor, whether the theft detection device is in motion. The controller is further configured to operate the emitter based on the sensed motion of the theft detection device and the light level sensed by the light sensor. The controller is also configured to wait for a predetermined period before causing the emitter to emit a signal if the light level sensed by the light sensor is below a threshold level, or if motion is detected by the motions sensor.

In a particular embodiment, the controller is configured to cause the emitter to emit a signal only for a set time period if the light level sensed by the light sensor is below the threshold level, or if motion is detected by the motions sensor. The predetermined period may be between five and 30 seconds. The controller may be configured to cause the emitter to emit a periodic warning signal during the predetermined time period before emitting an alarm signal.

Another embodiment of the invention relates to a method of controlling a theft detection device coupled to a product. The theft detection device includes a light sensor, a motion sensor, and an emitter. The method includes determining whether to control the emitter to emit an alarm signal. Determining whether to control the emitter to emit an alarm signal includes determining whether the theft detection device is in motion matching a predetermined motion profile. Determining whether to control the emitter to emit an alarm signal also includes determining whether the light sensor detects a light level below a predetermined light level. When it is determined to control the emitter to emit the alarm signal, causing the emitter to emit the alarm signal.

Another embodiment of the invention relates to a controller for a theft detection device configured to be coupled to a product. The theft detection device includes a light sensor, a motion sensor, and an emitter. The controller includes an output configured to be coupled to the emitter. The controller is configured to receive an input from the light sensor indicative of the light level sensed by the light sensor. The controller is configured to receive an input from the motion sensor indicative of when the motion sensor is in motion. The controller is configured to send a control signal to the emitter through the output to emit an alarm signal based on the input from the light sensor and the input from the motion sensor.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

While the invention will be described in connection with certain exemplary embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Before turning to the figures, which illustrate the exemplary embodiments in detail, it should be understood that the present application is not limited to the details or methodology set forth in the description or illustrated in the figures.

Generally one embodiment of a theft detection device shown in the figures as a merchandise tag is provided. In retail stores, thieves may tend to take products and place them into a bag, purse, or other enclosure, to hide the items. Low light levels around a product in conjunction with movement of a merchandise product are indicative that the product may be being stolen. A merchandise tag may be coupled to a product and detect low light levels and movement to determine when a potential theft condition exists.

Figure 1:
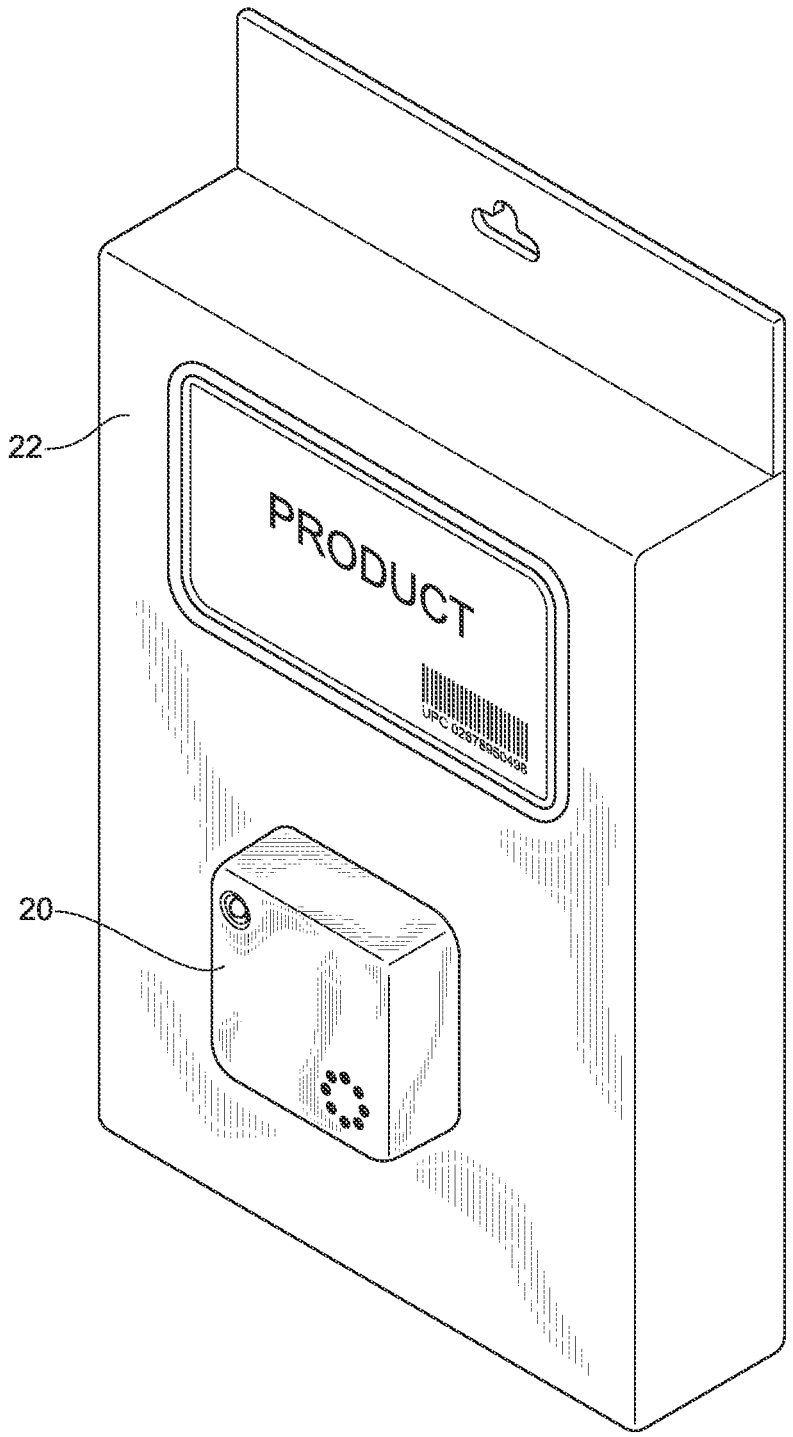
FIG. 1 is a perspective view of an embodiment of a theft detection device shown as a merchandise tag coupled to a product, such as a merchandise product.

With reference to FIG. 1, a theft detection device 20, in the form of a merchandise tag 20, is illustrated in the perspective view. With respect to embodiments of the invention described herein, the terms "theft protection device" and "merchandise tag" may be used interchangeably. The merchandise tag 20 is attached to a product, shown as a merchandise product 22. The merchandise tag 20 may be attached to any type of product to deter theft of the merchandise product. Additionally, the merchandise tag 20 may be coupled to any suitable surface of the merchandise product 22.

Figure 2:
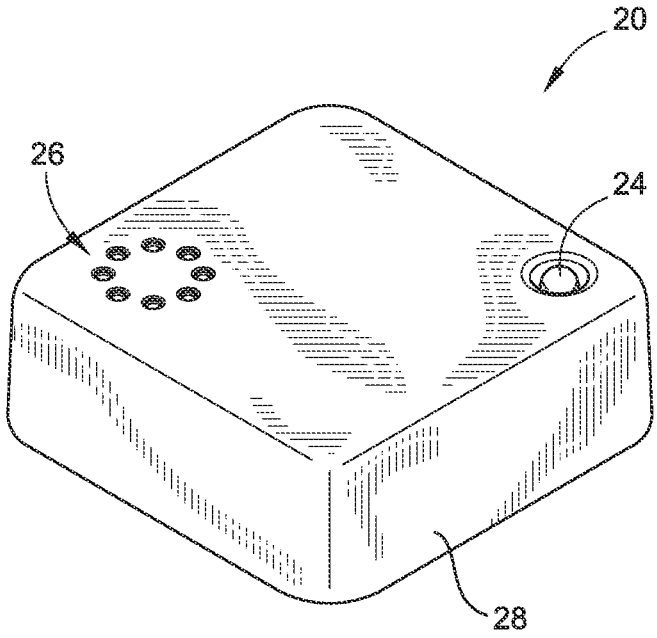
FIG. 2 is a top perspective view of the merchandise tag of FIG. 1.

As illustrated in FIG. 2, the merchandise tag 20 includes a light sensor 24 and an emitter 26. The light sensor 24 may be any suitable type of photocell, photo detector, photoresistor, light dependent resistor, or any other suitable type of light sensor. The emitter 26 may be configured to emit audible sound signals, infrared signals, visible light signals, RF signals, AM signals, FM signals, microwave signals, combinations thereof, or any other suitable type of signal.

The merchandise tag 20 also includes a housing 28. The housing 28 may include one or more tabs on a side panel adapter of the housing 28 to facilitate attachment of the merchandise tag 20 to various types of products 22. In particular embodiments, the housing 28 has a tab on each side panel adapter.

Figure 3:
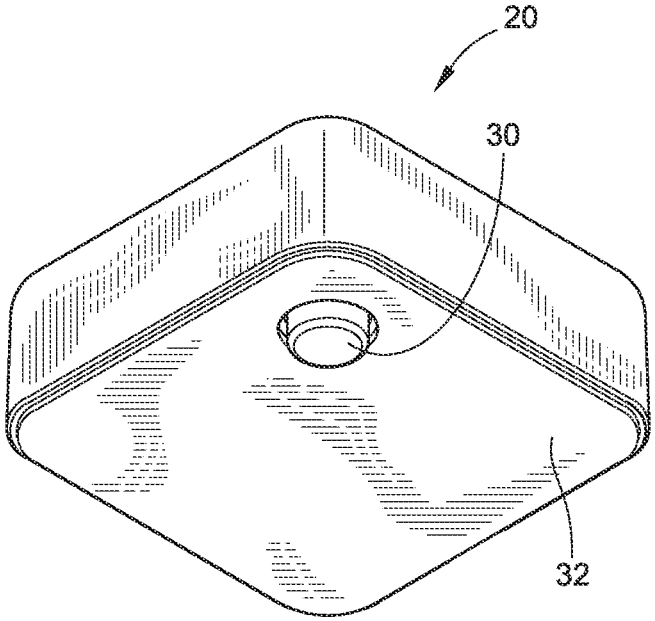
FIG. 3 is a bottom perspective view of the merchandise tag of FIGS. 1 and 2.

With reference to FIG. 3, in one embodiment the merchandise tag 20 includes an activator, such as an activation button 30. The activation button 30 projects through an attachment portion 32 of the merchandise tag 20. The activation button 30 is configured to activate the merchandise tag 20 when actuated, in the illustrated embodiment depressed. When the attachment portion 32 of the merchandise tag 20 is coupled to a merchandise product 22, the activation button 30 is depressed, activating the merchandise tag 20. In one embodiment, the attachment portion 32 may include adhesive to couple the merchandise tag 20 to a merchandise product. In other embodiments, the merchandise tag 20 may be attached to a merchandise product by any other suitable mechanism (e.g., staple, tape, tie, etc.). In one embodiment the merchandise tag 20 is configured to be permanently attached to the merchandise product 22. In another embodiment the merchandise tag 20 is configured to be releasably attached to the merchandise product 22.

Figure 4:
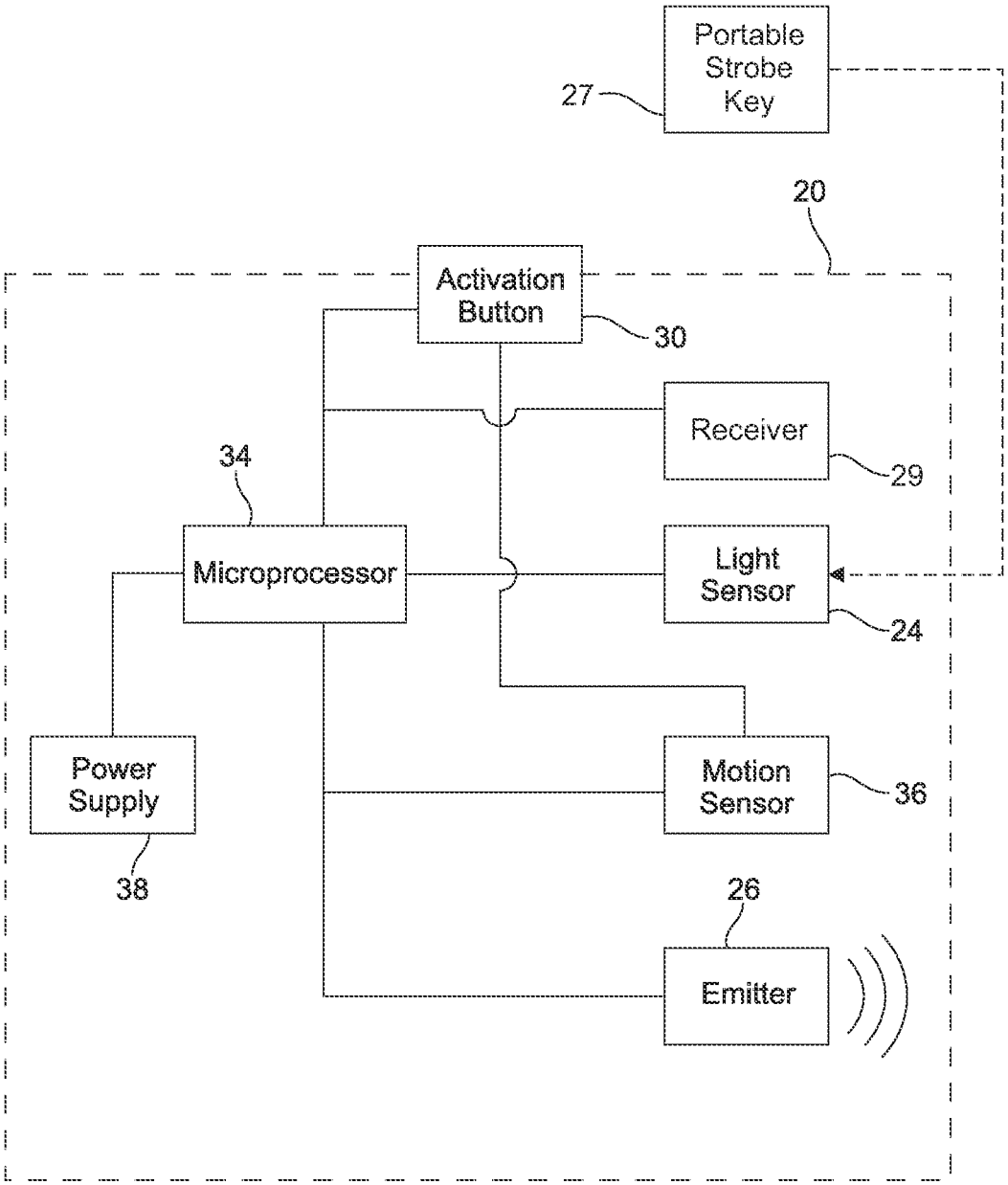
FIG. 4 is a block diagram of an embodiment of a merchandise tag.

FIG. 4 is a schematic illustration of the merchandise tag 20. The merchandise tag 20 includes a controller, illustrated in FIG. 4 as a microprocessor 34. The microprocessor 34 is electrically coupled with the light sensor 24 and the emitter 26. The merchandise tag 20 also includes a motion sensor 36. The microprocessor 34 is also electrically coupled to the motion sensor 36. As is further described below, the microprocessor 34 is configured to determine from the light sensor 24 and motion sensor 36 when the merchandise tag 20, and thus the merchandise product to which it is attached, is in low light and in motion, indicating a potential theft condition.

The activation button 30 is configured to activate the motion sensor 36 when the activation button 30 is actuated. In one embodiment, the activation button 30 is also coupled to the microprocessor 34 with the microprocessor 34 configured to determine when the activation button 30 is in an actuated state or an unactuated state. Additionally, the microprocessor 34 is coupled to a power supply 38. The power supply 38 may be a battery, solar cell, or any other suitable power supply.

Embodiments of merchandise tags, such as, e.g., merchandise tag 20, may be controlled according to various methods, as will be further described below. In one embodiment a merchandise tag 20 is coupled to a merchandise product 22 and activated. When a light sensor 24 of the merchandise tag 20 detects a light level below a predetermined light level and the motion sensor 36 of the merchandise tag 20 detects movement of the merchandise tag 20 for more than a predetermined alarm time period, without the light sensor 24 detecting a light level that is at or above the predetermined light level or the motion sensor 36 detecting that the merchandise tag 20 is no longer in motion for more than a preset interruption time, the controller 34 controls the emitter 26 to emit an alarm signal.

Figure 5:
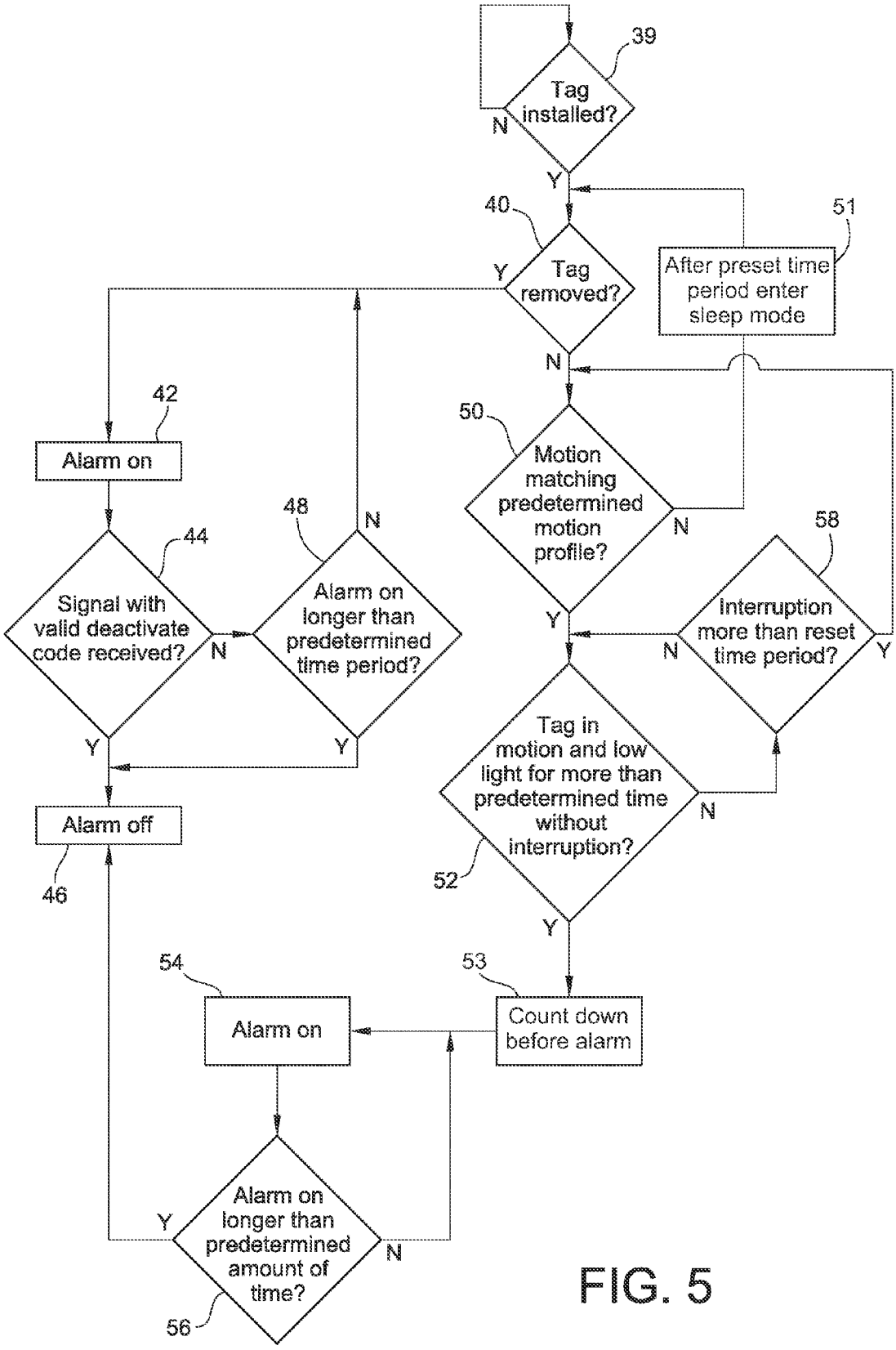
FIG. 5 is a flow diagram illustrating an embodiment of a method of controlling an embodiment of a merchandise tag.

With reference to FIG. 5, a flow diagram of an embodiment of a method of controlling an embodiment of a merchandise tag 20 is illustrated. The embodiment of the method may be used to control a merchandise tag 20, illustrated in FIGS. 1-4. The embodiment of the method may also be used to control other embodiments of merchandise tags. In one embodiment, the merchandise tag 20 controlled with the embodiment of the method described below includes the microprocessor or controller 34 coupled to the emitter 26, the light sensor 24, and the motion sensor 36. In another embodiment, the merchandise tag 20 also includes a receiver 29 coupled to the microprocessor or controller 34.

In one embodiment, the controller 34 determines whether the merchandise tag 20 has been installed on a merchandise product (step 39). If the merchandise tag 20 has not been installed, the controller 34 returns to step 39. If the merchandise tag 20 has been installed, the controller 34 determines whether the merchandise tag 20 has been removed from a merchandise product 22 (step 40), e.g., by determining whether the activator of the merchandise tag 20 has been actuated. In one embodiment, the controller 34 remains in a sleep/power saving mode until it is triggered, e.g., by actuation of an activation button of the merchandise tag 20, i.e., until the merchandise tag 20 has been installed on a merchandise product 22. In some embodiments, the controller 44 is configured to enter the theft detection device 20 into a sleep mode when no motion is detected for a predetermined period of time.

In a particular embodiment, the controller 34 is configured to enter the theft detection device 20 into the sleep mode when no motion is detected for preset time period (step 51), for example 30 seconds, though the preset time period could be longer or shorter than 30 seconds. In a more particular embodiment of the invention, after entering sleep mode, the controller 34 is configured to exit the theft detection device 20 from the sleep mode when the motion sensor 36 detects motion for a threshold time period (e.g., at least three consecutive seconds). In some embodiments, after exiting sleep mode, if the light sensed by the light sensor 24 is below a threshold level, the controller 34 is configured to cause the emitter 26 to emit an alarm signal after a countdown period (step 53). The countdown period may typically range from 5 seconds to 30 second, but could be shorter or longer if desired. In particular embodiments, after exiting sleep mode, if no movement is detected for a predetermined time period, the controller 34 enters theft detection device 20 into the sleep mode. For example, if the motion sensor 26 detects movement for the aforementioned threshold time period, the controller 34 brings the theft detection device 20 out of sleep mode. In a particular embodiment, after exiting sleep mode, if the motion sensor 36 does not motion for a period ranging from 15 seconds to one minute (though the period could be longer or shorter), the controller 34 puts the theft detection device 20 back into sleep mode.

If the tag has been removed, the controller 34 controls the emitter 26 of the theft protection device or merchandise tag 20 to emit an alarm signal (step 42). The controller 34 determines if the merchandise tag 20 has received a signal with a valid deactivate code (step 44). In a particular embodiment, the controller 34 is configured to deactivate the merchandise tag 20 when the light sensor detects a coded light sequence. The merchandise tag 20 may also include a handheld strobe device 27 (also referred to as a portable strobe key) for activating and deactivating the theft protection device. For example, the merchandise tag 20 may be configured to receive a signal including a deactivation code from a portable strobe key 27, such as that described in U.S. patent application Ser. No. 13/591,040, entitled "Theft Detection System", filed on Aug. 21, 2012, which is incorporated herein by reference in its entirety. In one embodiment, the light sensor 24 is configured to receive a pattern of flashing light (e.g., spatial pattern, series of flashes on and off of portable strobe key 27, etc.). The controller 34 determines if the pattern received by the light sensor 24 is a valid deactivation pattern (e.g., matches a preprogrammed deactivation code, etc.).

In an exemplary embodiment, the controller 34 may also be configured to deactivate the merchandise tag 20 for a predetermined period of time (e.g., from 5 to 30 seconds) when the light sensor detects the coded light sequence. The controller 34 may be further configured to keep the merchandise tag 20 deactivated if the merchandise tag 20 is decoupled from the product 22 during the predetermined period of time.

In certain embodiments, the controller 34 is configured to re-activate the theft protection device 20 if the theft protection device 20 is subsequently coupled to some product 22. The controller 34 may be configured to re-activate the theft protection device 20 if the theft protection device 20 is not decoupled from the product 22. The controller 34 may be further configured to recognize multiple coded light sequences for deactivation of the merchandise tag 20.

Additionally, in other embodiments, the controller 34 may receive a deactivation code from any suitable signal source, e.g., at check out, from employee working with merchandise, etc. In one embodiment where the merchandise tag 20 includes the receiver 29, the controller 34 may be configured to receive any suitable type of signal including a deactivation code, including, for example, RF signals, infrared signals, audible signals, light signals, combinations of these, or other suitable signals.

The controller 34 determines if a deactivate code signal has been received, and if so, whether the deactivate code signal contains a valid deactivate code (step 44). If a signal with a valid deactivate code has been received, the controller 34 controls the emitter 26 to stop emitting the alarm signal (step 46). If the controller 34 determines that it has not received a signal with a deactivate code or that the deactivate code received is not valid, the controller 34 determines whether the emitter 26 has been emitting the alarm signal for longer than a predetermined alarm time period (step 48). If the emitter 26 has not been emitting the alarm signal for longer than the predetermined alarm time period, the controller 34 returns to step 42 and continues to control the emitter 26 to emit an alarm signal. If the controller 34 determines that the emitter 26 has been emitting the alarm signal for longer than the predetermined alarm time period, the controller 34 controls the emitter 26 to stop emitting the alarm signal (step 46).

In certain embodiments of the invention, the controller 34 is configured to wait for a predetermined period, similar to a countdown time, before causing the emitter 26 to emit a signal if the light level sensed by the light sensor 24 is below a threshold level, or if motion is detected by the motions sensor 36. The countdown time may typically last from five seconds to 30 seconds.

In a particular embodiment, the controller 34 is configured to cause the emitter 26 to emit a signal only for a set time period if the light level sensed by the light sensor 24 is below the threshold level, or if motion is detected by the motions sensor 36. For example, the set time period may be between five and 30 seconds, or any suitable time in which the user determines the signal would likely be received by security or store personnel. The controller 34 may also be configured to cause the emitter 26 to emit a periodic warning signal during the predetermined warning period before emitting an alarm signal. For example, the controller 34 may cause the emitter 26 to emit a beeping signal once per second or every other second for the predetermined warning period before sounding the alarm signal.

With reference to step 40, if the controller 34 determines that the merchandise tag 20 has not been removed from the merchandise product 22, the controller 34 determines whether the merchandise tag 20 is in motion matching a predetermined motion profile (e.g., motion for a predetermined motion length of time without a stop of motion for more than a predetermined motion stop time) (step 50). In various embodiments the motion profile is selected based on motion conditions matching a conditions indicative of theft (e.g., a thief must move the merchandise product 22 from the area in which it is displayed to the exit and may not set the merchandise product 22 down, thus, in one embodiment a predetermined motion profile is movement for an extended period without the merchandise product 22 stopping moving for more than a predetermined stop time period). If the controller 34, via the motion sensor 36, determines that the merchandise tag 20 is not in motion matching a predetermined motion profile, the controller 34 proceeds to step 40.

In one embodiment, once the controller 34 determines that the merchandise tag 22 is in motion matching the predetermined motion profile, the controller 34 will make an additional determination before controlling the emitter 26 to emit an alarm signal. In one embodiment if a merchandise product 22 is being stolen, it may be placed in a low-light environment while the thief moves towards other items or an exit (e.g., placed in a purse, pocket, or bag while the thief moves). In one embodiment, the controller 34 determines whether an input from the light sensor 24 indicates that the merchandise tag 20 is in a low-light environment. Additionally, the controller 34 also determines whether an input from the motion sensor 36 indicates that the merchandise tag 20 is in motion. If the controller 34 determines from these inputs that the merchandise tag 20 is both in motion and in a low-light environment for more than a predetermined time period, the controller 34 controls the emitter 26 to emit an alarm signal.

If the controller 34 determines that the merchandise tag 20 is in motion matching a predetermined motion profile, the controller 34 determines whether the merchandise tag 20 is in motion and low light for more than a predetermined time without interruption of more than a predetermined interruption time (step 52) (e.g., whether the motion sensor 36 senses motion and the light sensor 24 senses a light level below a predetermined light level for more than a predetermined time period without the motion sensor 36 not sensing motion or the light sensor 24 not sensing a light level below a predetermined light level for more than a predetermined interruption time period).

If the controller 34 determines that the merchandise tag 20 is in motion and low light for more than the predetermined time without interruption for more than a predetermined interruption time, the controller 34 controls the emitter 26 to emit an alarm signal (step 54). The controller 34 determines whether the emitter 26 has been emitting an alarm for more than a predetermined time period (step 56). If the controller 34 determines that the emitter 26 has not been emitting an alarm signal for more than the predetermined time period, the controller 34 proceeds to step 54. If the controller 34 determines that the emitter 26 has been emitting an alarm signal for more than the predetermined time period, the controller 34 controls the emitter 36 to stop emitting the alarm signal (step 46).

Generally, in one embodiment, when a merchandise tag 20 coupled to a merchandise product 22 is put into, for example, a pocket to be stolen, the merchandise tag 20 may determine that a condition potentially indicative of theft exists and emit an alarm signal.

In one embodiment, the controller 34 first determines whether the merchandise tag 20 and the merchandise product 24 are in motion that matches a predetermined motion profile (e.g., if a merchandise product 22 is put into a thief's pocket and walked toward an exit, the merchandise product 22 may be in motion without interruption for longer than a predetermined time period; if the motion profile is set as motion for longer than a predetermined time period, the merchandise tag 20 will determine that the merchandise product 22 is in motion that matches the predetermined motion profile).

In one embodiment, once the controller 34 has determined that the merchandise product 22 is in motion that matches the predetermined motion profile, the controller 34 monitors the light level and motion of the merchandise tag 20 to determine whether to control the emitter 26 to emit an alarm signal (e.g., the controller 34 monitors the input from the light sensor 24 to determine whether the merchandise product 22 is in a low light environment and monitors the input from the motion sensor 36 to determine whether the merchandise product 22 is also in motion). In one embodiment, when the controller 34 determines that the merchandise tag 20 is both in a low-light environment and in motion for a predetermined amount of time, e.g., the merchandise tag 20 coupled to a merchandise product 22 is in a pocket of a thief moving towards an exit, for example, the controller 34 may determine to control the emitter 26 to emit an alarm signal. In one embodiment the merchandise tag 20 also monitors whether either the light level or motion is interrupted for more than a predetermined time period (e.g., the potential thief removes the merchandise product 22 with the merchandise tag 20 from his or her pocket and leaves it on a shelf, no longer in a low-light condition and no longer in motion) and if so, may determine not to emit an alarm signal.

With reference to step 52, if the controller 34 determines that the low light or motion of the merchandise tag 20 have been interrupted for more than the predetermined interruption time period, the controller 34 determines whether the interruption of motion or low light has been for more than a predetermined reset time period (step 58). If controller 34 determines that the interruption has not been for more than a predetermined reset time period, the controller 34 proceeds to step 52. If the controller 34 determines that the interruption has been for more than a reset time period, the controller 34 proceeds to step 50.

With reference to FIGS. 4 and 6-8, a flow diagram of another embodiment of a method of controlling an embodiment of the merchandise tag 20 is illustrated. In one embodiment, the method may be used to control the merchandise tag 20 such as merchandise tag 20, illustrated in FIGS. 1-4. The embodiment of the method may also be used to control other embodiments of merchandise tags 20. In one embodiment, the merchandise tag 20 controlled with the embodiment of the method described below includes a controller 34 coupled to an emitter 26, the light sensor 24, and the motion sensor 36. In another embodiment, the merchandise tag 20 also includes the receiver 29 coupled to the controller 34.

In the illustrated embodiment, the controller 34 determines whether or not the merchandise tag 20 is coupled to a merchandise product 22 (step 60). In one embodiment, the controller 34 does so by determining whether or not the activation button 30 of the merchandise tag 20 has been actuated.

When the controller 34 determines that the merchandise tag 20 has been installed, the controller 34 controls the emitter 26 to emit a signal indicating installation, in the illustrated embodiment, an audible confirmation beep (step 62). In other embodiments, the emitter 26 may emit any other suitable type of signal.

The controller 34 determines whether the merchandise tag 20 has been removed from the merchandise product 22 (step 64) (e.g., in one embodiment indicated by whether or not the activation button 30 is actuated). If the controller determines that the merchandise tag 20 has been removed, it controls the emitter 26 to emit an alarm signal (step 66), or continues causing the emitter 26 to emit an alarm signal if it is already causing the emitter 26 to emit an alarm signal. The controller 34 keeps track of whether the emitter 26 is emitting an alarm signal ("Alarm"), for example with an alarm status variable, flag, etc.

The controller 34 determines whether it has received a signal with a valid deactivate code (step 68). In one embodiment, when the receiver 29 of the merchandise tag 20 receives a signal including a deactivate code, the controller 34 determines whether the deactivate code is valid, and if it is valid, the controller 34 stores that a valid deactivate code has been received ("Valid Deactivate Code"). The signal with the deactivate code may be any suitable type of signal including any suitable code, protocol, indicator, etc., from which the controller 34 may determine that the deactivate code is valid. If the controller 34 determines that a valid deactivate code has been received, the controller 34 controls the emitter 26 to stop emitting the alarm signal and resets "Alarm" (step 70).

Additionally, in one embodiment, the controller 34 keeps track of the amount of time that the alarm has been on ("Alarm ON Time"). If the controller 34 determines that a valid deactivate code has been received, the controller resets the "Alarm ON Time" (step 72).

As described further below, in one embodiment the controller 34 determines when the light level is below a predetermined light level and when the light level is above a predetermined light level. Additionally, the controller 34 determines when the merchandise tag 20 is in motion matching a predetermined motion profile. When the controller 34 determines that the light level is below a predetermined light level and the merchandise tag 20 is in motion matching a predetermined motion profile, the controller 34 keeps track of the fact that both of these conditions are present (activates "L+V Active") and keeps track of how long these conditions are both present (length of time of "L+V Active").

In one embodiment, when the controller 34 determines that either the light level is above the predetermined light level or the merchandise tag 20 is not in motion matching a predetermined motion profile, the controller 34 deactivates "L+V Active" ("L+V Active" idle) and keeps track of how long either the light level is above the predetermined light level or the merchandise tag 20 is not in motion matching a predetermined motion profile (length of time of "L+V Idle").

If the controller 34 determines that a valid deactivate code has been received, the controller resets "L+V Idle" (step 74), resets "L+V Active" (step 76), resets "Valid Deactivate Code" (step 78), and proceeds to step 60. After the controller resets "Valid Deactivate Code" (step 78), the controller 34 will determine that the merchandise tag 20 has not received valid deactivate code the next time that the controller 34 reaches step 68 unless the merchandise tag 20 receives a signal with a valid deactivate code after "Valid Deactivate Code" has been reset by the controller 34 (step 78).

With reference to step 68, if the controller 34 determines that a signal with a valid deactivate code has not been received, the controller 34 determines whether the emitter 26 has been emitting an alarm signal for less than a predetermined alarm time period, in the illustrated embodiment, whether "Alarm ON Time" is less than three minutes (step 80). If the emitter 26 has been emitting an alarm signal for less than the predetermined alarm time period (if "Alarm ON Time" is less than three minutes), the controller 34 updates the amount of time that the emitter 26 has been emitting the alarm signal (increases "Alarm ON Time) (step 82) and proceeds to step 66.

With reference to step 64, if the controller 34 determines that the merchandise tag 20 has not been removed from the merchandise product 22, the controller 34 determines whether there is motion matching a predetermined motion profile (step 84).

Figure 6:
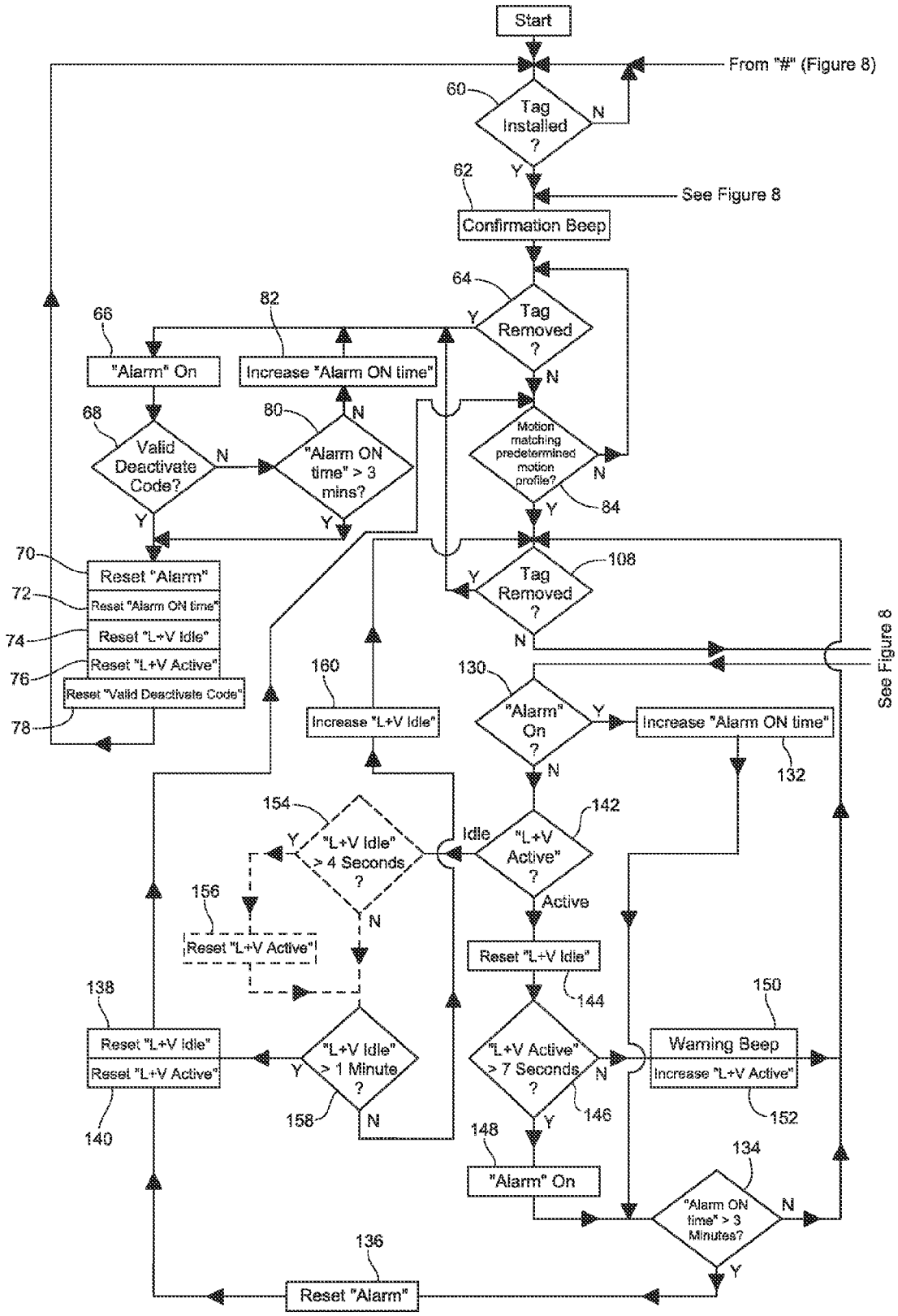
FIG. 6 is a flow diagram illustrating another embodiment of a method of controlling an embodiment of a merchandise tag.
Figure 7:
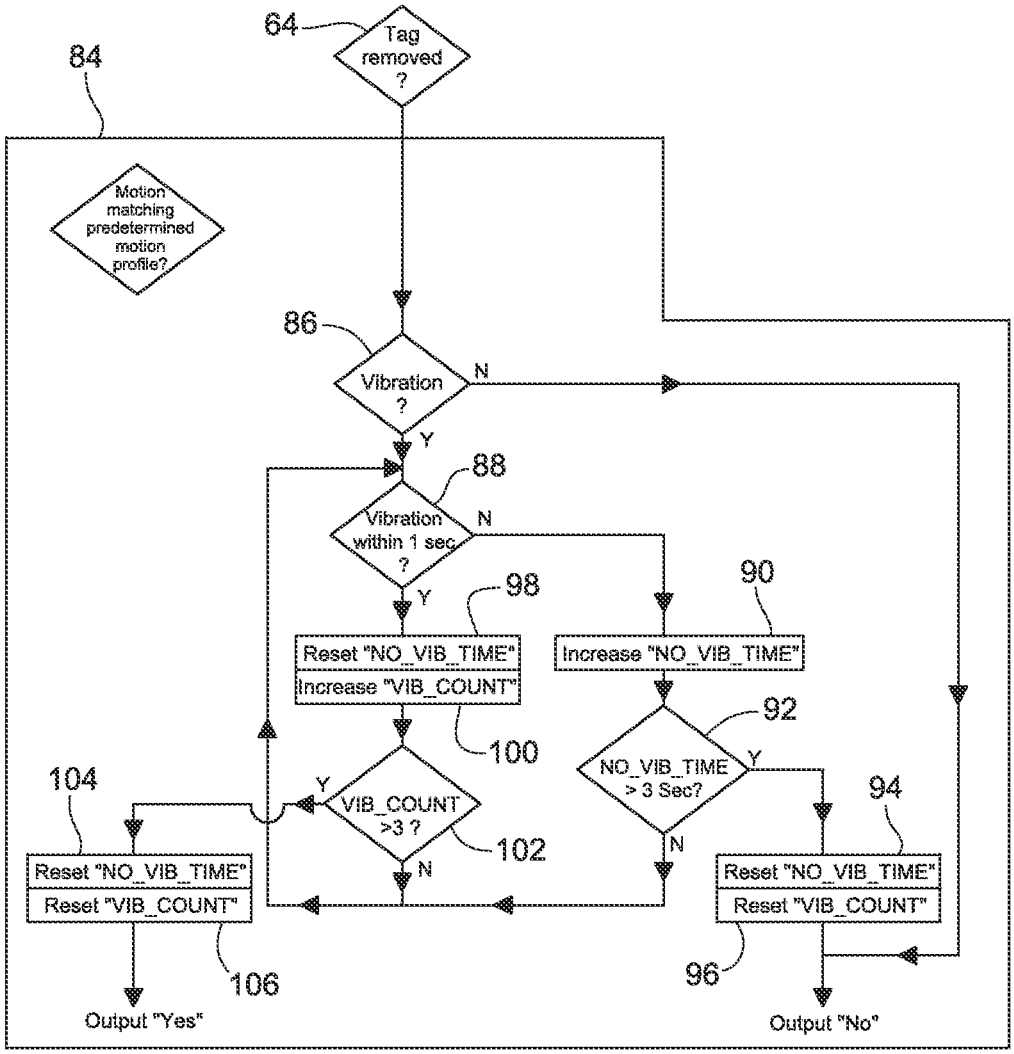
FIG. 7 is a detail flow diagram illustrating an embodiment of sub-steps of step 84 in FIG. 6 according to an exemplary embodiment.

FIG. 7 illustrates an embodiment of a method of determining whether an embodiment of a merchandise tag 20 is in motion matching a predetermined motion profile. The controller 34 determines whether there is vibration of the merchandise tag (step 86), e.g., from a signal received from the motion sensor 36. If the controller determines that there is no vibration of the merchandise tag 20, the controller determines that there is no motion matching a predetermined motion profile and proceeds to step 64 (FIG. 6).

If the controller 34 determines that there is vibration of the merchandise tag 20, the controller 34 determines whether there has been vibration within the last predetermined vibration time period, illustrated in FIG. 6 as whether there has been vibration within one second (step 88).

The controller 34 keeps track of the amount of time that there has been no vibration of the merchandise tag ("NO_VIB_TIME"). Additionally, the controller 34 keeps track of the amount of times that the controller 34 has determined that there has been vibration of the merchandise tag 20 within one second ("VIB_COUNT").

If the controller 34 determines that there has not been vibration within 1 second, the controller 34 increases "NO_VIB_TIME" (step 90). The controller 34 determines whether the "NO_VIB_TIME" is greater than a predetermined no vibration time period, in the illustrated embodiment whether "NO_VIB_TIME" is greater than three seconds (step 92).

If the controller 34 determines that "NO_VIB_TIME" is not greater than three seconds, the controller proceeds to step 88. If the controller 34 determines that "NO_VIB_TIME" is greater than three seconds, the controller 34 determines that there is not motion matching a predetermined motion profile, resets "NO_VIB_TIME" (step 94), resets "VIB_COUNT" (step 96) and proceeds to step 64 (FIG. 6).

If the controller 34 determines that there has been vibration within one second (step 88), the controller 34 resets "NO_VIB_TIME" (step 98) and increases "VIB_COUNT" (step 100). The controller 34 determines whether "VIB_COUNT" is greater than a predetermined amount, in the illustrated embodiment, whether "VIB_COUNT" is greater than three (step 102). If the controller 34 determines that "VIB_COUNT" is not greater than three, the controller 34 proceeds to step 88. If the controller 34 determines that "VIB_COUNT" is greater than three, the controller 34 resets "NO_VIB_TIME" (step 104), resets "VIB_COUNT" (step 106), determines that there is motion matching a predetermined motion profile, and proceeds to step 108 (FIG. 6).

With reference to FIG. 6, the controller 34 determines whether the merchandise tag 20 has been removed (step 108). If the merchandise tag 20 has been removed, the controller 34 proceeds to step 66.

Figure 8:
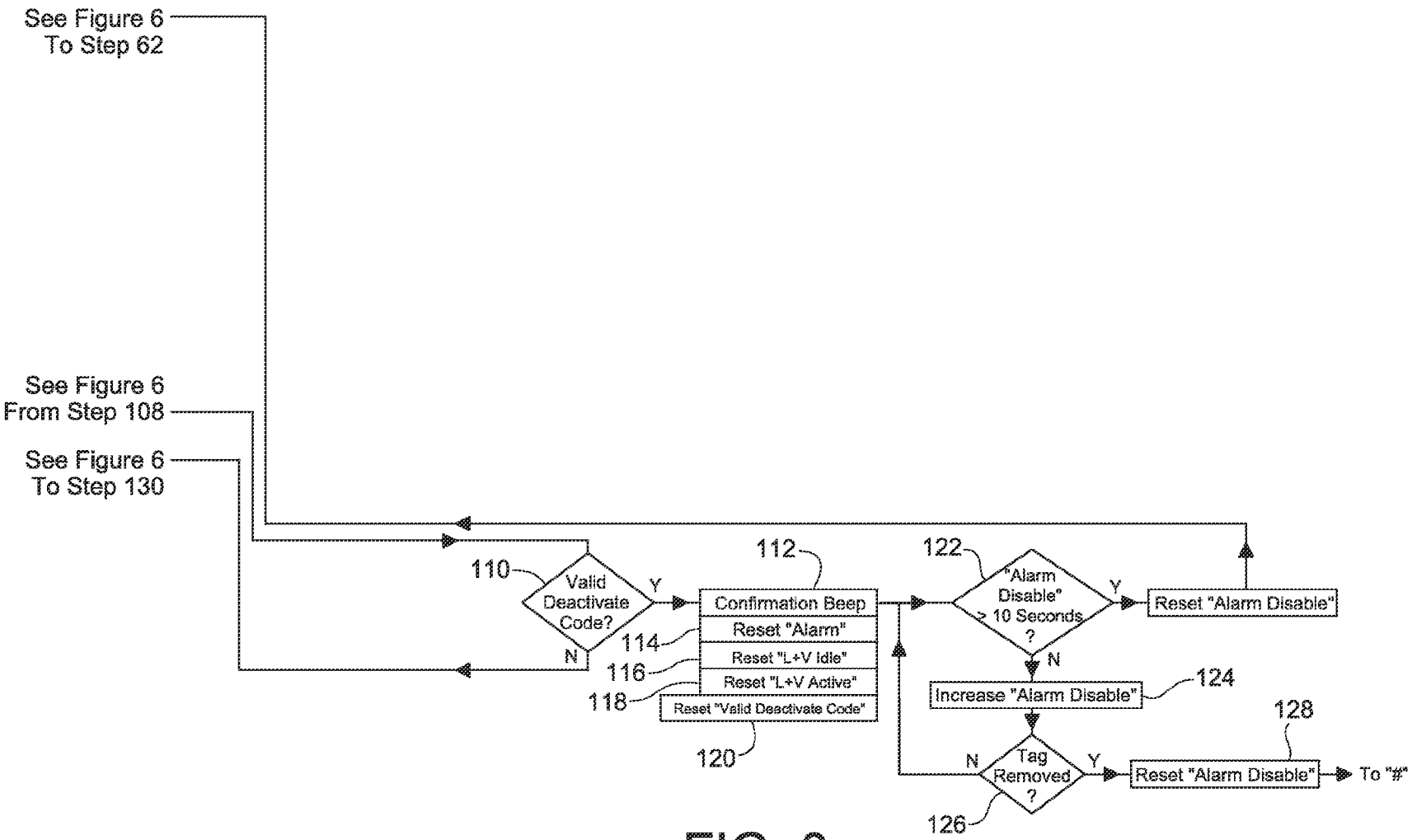
FIG. 8 is a flow diagram illustrating an embodiment of a portion the method illustrated in and continued from FIG. 6 as indicated in FIG. 6.

With reference to FIGS. 6 and 8, if the controller 34 determines that the merchandise tag 20 has not been removed, the controller 34 determines whether the merchandise tag 20 has received a signal containing a valid deactivate code (step 110). If the merchandise tag 20 has received a signal containing a valid deactivate code, the controller 34 controls the emitter 26 to emit a signal (step 112), illustrated in FIG. 8 as a confirmation beep. The controller 34 resets "Alarm" (step 114), resets "L+V Idle" (step 116), resets "L+V Active" (step 118), and resets "Valid Deactivate Code" (step 120).

The controller 34 may not control the emitter 26 to emit an alarm for a period of time after determining in step 110 that a signal containing a valid deactivate code has been received by the merchandise tag 20. The controller 34 keeps track of the amount of time that the controller 34 is in the state in which it may not control the emitter 26 to emit an alarm ("Alarm Disable"). The controller 34 determines whether "Alarm Disable" is greater than ten seconds (step 122). If "Alarm Disable" is not greater than ten seconds, the controller 34 increases "Alarm Disable" (step 124). The controller 34 determines if the merchandise tag 20 has been removed from the merchandise product 22 (step 126). If the merchandise tag 20 has not been removed from the merchandise product 22, the controller 34 proceeds to step 122.

If the controller determines that the merchandise tag 20 has been removed, the controller 34 resets "Alarm Disable" (step 128) and proceeds to step 60 (see FIG. 6).

If the controller 34 determines in step 122 that "Alarm Disable" is greater than ten seconds, the controller 34 resets "Alarm Disable" (step 129) and proceeds to step 62 (see FIG. 6).

With reference to FIG. 6, the controller 34 determines whether "Alarm" is on (step 130), i.e., whether the emitter 26 is emitting an alarm signal. If "Alarm" is on, the controller increases "Alarm ON Time" (step 132). The controller 34 determines if "Alarm ON Time" is greater than three minutes (step 134). If "Alarm ON Time" is not greater than three minutes, the controller 34 proceeds to step 108.

If the controller 34 determines that "Alarm ON Time" is greater than three minutes, the controller 34 controls the emitter 26 to stop emitting an alarm signal and resets "Alarm" (step 136), resets "L+V Idle" (step 138), rests "L+V Active" (step 140), and proceeds to step 84.

If the controller 34 determines at step 130 that "Alarm" is not on (e.g., that the emitter 26 is not emitting an alarm signal), the controller 34 determines whether "L+V Active" is active or idle (step 142), i.e., whether or not both the light is below the predetermined light level and the merchandise tag is in motion.

If "L+V Active" is active, the controller 34 resets "L+V Idle" (step 144). The controller 34 determines whether "L+V Active" is greater than a predetermined "L+V Active" time period, in the embodiment illustrated in FIG. 6 whether "L+V Active" is greater than seven seconds (step 146). If "L+V Active" is greater than seven seconds, the controller 34 controls the emitter 26 to emit an alarm signal and sets "Alarm" to on (step 148). The controller 34 determines whether "Alarm ON Time" is greater than a predetermined "Alarm ON Time" time period, in the illustrated embodiment three minutes (step 134). If the "Alarm ON Time" is not greater than three minutes, the controller 34 proceeds to step 108. If the "Alarm ON Time" is greater than three minutes, the controller 34 resets "Alarm" and controls the emitter 26 to stop emitting the alarm signal (step 136), resets "L+V Idle" (step 138), resets "L+V Active" (step 140) and proceeds to step 84.

With reference to step 146, if the controller 34 determines that "L+V Active" is not greater than seven seconds, the controller 34 controls the emitter 26 to emit a warning signal, in the illustrated embodiment, an audible warning beep (step 150), increases "L+V Active" (step 152), and proceeds to step 108. In one embodiment, by emitting a warning beep, an embodiment of a merchandise tag 20 may allow a potential thief to reconsider the theft and return the merchandise product 22 before the emitter 26 emits an alarm signal. In one embodiment the warning beep is approximately 60 decibels.

With reference to step 142, if the controller 34 determines that "L+V Active" is idle, the controller 34 determines whether "L+V Idle" is greater than a predetermined "L+V Active" reset time period, in the illustrated embodiment four seconds (step 154).

If "L+V Idle" is greater than four seconds, the controller resets "L+V Active" (step 156). The controller 34 determines whether "L+V Idle" is greater than a predetermined "L+V" reset time period, in the illustrated embodiment one minute (step 158). If "L+V Idle" is not greater than one minute, the controller 34 increases "L+V Idle" (step 160) and proceeds to step 108. If "L+V Idle" is greater than one minute, the controller 34 resets "L+V Idle" (step 138), resets "L+V Active" (step 140), and proceeds to step 84.

Thus, generally, in one embodiment, once the controller 34 has determined that merchandise tag 20 is in motion matching a predetermined motion profile, the controller 34 determines whether the merchandise tag 20 is both in motion and the light is below the predetermined light level for longer than a predetermined time period without interruption of these two conditions for more than a predetermined interruption time. If so, the controller 34 is configured to control the emitter 26 to emit an alarm signal. However, if the merchandise tag 20 is both in motion matching a predetermined motion profile and the light is below the predetermined light level for the predetermined time period or less the controller 34 does not control the emitter 26 to emit an alarm signal. And, if either of these conditions are interrupted for more than a predetermined interruption time (e.g., the merchandise tag 20 stops moving for longer than the predetermined interruption time, the light level goes above the predetermined light level for more than the predetermined interruption time, etc.), the time period required for an alarm for motion matching a predetermined motion profile and light below the predetermined light level is reset.

Figure 9:
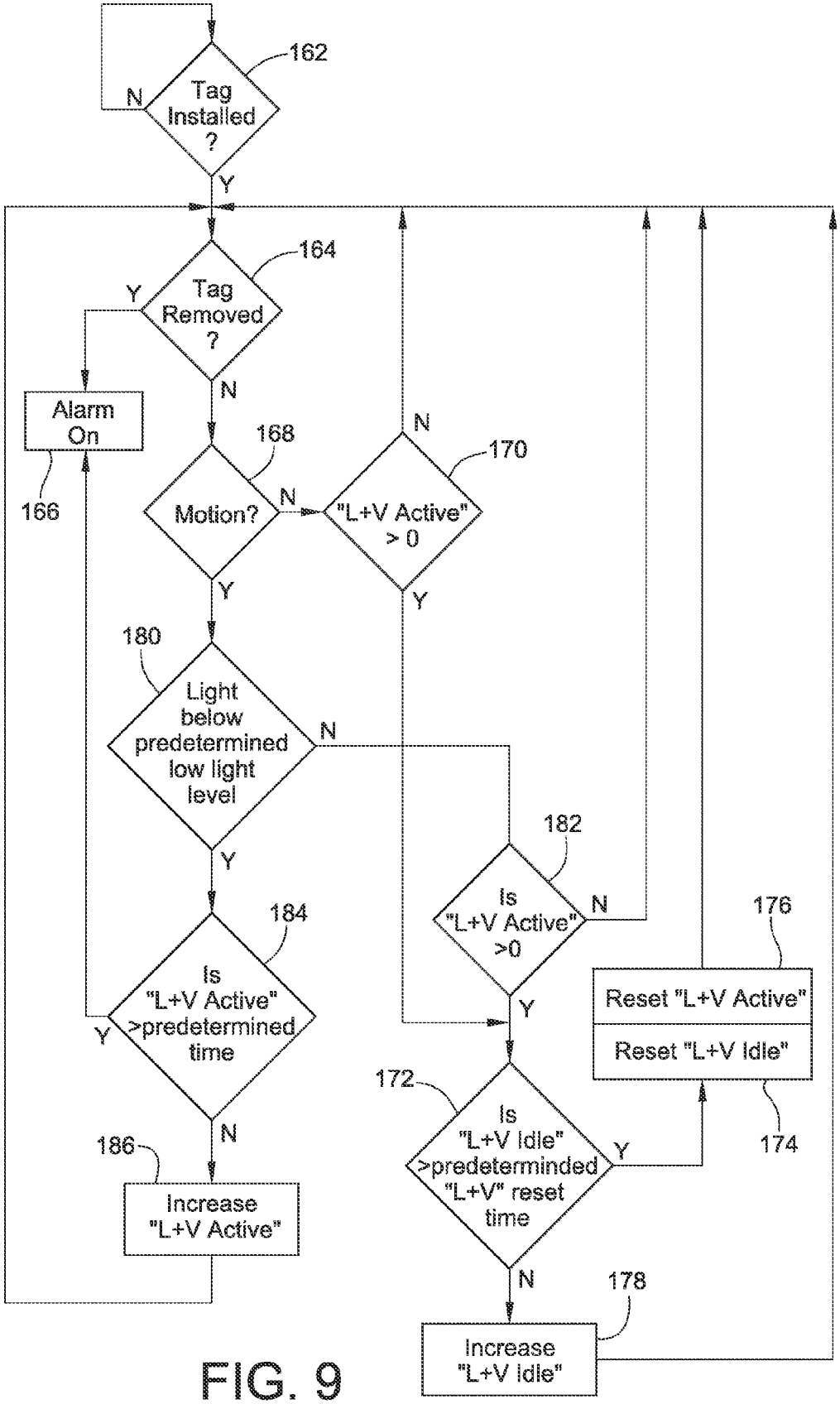
FIG. 9 is a flow diagram of another embodiment of a method of controlling an embodiment of a merchandise tag.

With reference to FIG. 9, a flow diagram of an embodiment of a method of controlling an embodiment of a merchandise tag is illustrated. The embodiment of the method may be used to control a merchandise tag such as merchandise tag 20, illustrated in FIGS. 1-4. The embodiment of the method may also be used to control other embodiments of merchandise tags. In one embodiment, the merchandise tag controlled with the embodiment of the method described below includes the controller 34 coupled to the emitter 26, the light sensor 24, and the motion sensor 36. In another embodiment, the merchandise tag 20 also includes the receiver 29 coupled to the controller 34.

In one embodiment, when the merchandise tag 20 is installed (step 162) on the merchandise product 22, the controller 34 determines whether the merchandise tag 20 has been removed from the merchandise product 22 (step 164). If the controller 34 determines that the merchandise tag 20 has been removed from the merchandise product 22, the controller 34 controls the emitter 26 to emit an alarm signal (step 166). If the controller 34 determines that the merchandise tag 20 has not been removed from the merchandise product 22, the controller 34 determines whether the merchandise tag 20 is in motion (step 168) (e.g., whether the motion sensor 36 signals to the controller 34 that the merchandise tag 20 is in motion).

As in the previous embodiment, in one embodiment the controller 34 determines when the light level is below a predetermined light level and when the light level is above a predetermined light level. When the controller 34 determines that the light level is below a predetermined light level and the merchandise tag 20 is in motion, the controller 34 keeps track of the fact that both of these conditions are present and keeps track of how long these conditions are both present ("L+V Active").

If the controller 34 determines that the merchandise tag 20 is not in motion, the controller 34 determines whether "L+V Active" is greater than zero (step 170). If "L+V Active" is not greater than zero, the controller 34 proceeds to step 164. If the controller 34 determines that "L+V Active" is greater than zero, the controller 34 determines whether "L+V Idle" is less than a predetermined "L+V" reset time (step 172).

If "L+V Idle" is greater than the predetermined "L+V" reset time, the controller 34 resets "L+V Idle" (step 174), resets "L+V Active" (step 176), and proceeds to step 164. If "L+V Idle" is not greater than the predetermined "L+V" reset time, the controller 34 increases "L+V Idle" (step 178) and proceeds to step 164.

With reference to step 168, if the controller 34 determines that the merchandise tag 20 is in motion, the controller 34 determines whether the light level is below a predetermined low light level (step 180). If the light is not below the predetermined low light level, the controller 34 determines whether "L+V Active" is greater than zero (step 182).

If "L+V Active" is not greater than zero, the controller 34 proceeds to step 164. If "L+V Active" is greater than zero, the controller 34 determines whether "L+V Idle" is greater than the predetermined "L+V" reset time (step 172). If "L+V Idle" is greater than the predetermined "L+V" reset time, the controller 34 resets "L+V Idle" (step 174), resets "L+V Active" (step 176), and proceeds to step 164. If "L+V Idle" is not greater than the predetermined "L+V" reset time, the controller 34 increases "L+V Idle" (step 178) and proceeds to step 164.

With reference to step 180, if the controller 34 determines that the light level is below the predetermined low light level, the controller 34 determines whether "L+V Active" is greater than a predetermined "L+V Active" time period (step 184).

If "L+V Active" is greater than the predetermined "L+V Active" time period, the controller 34 controls the emitter 26 to emit an alarm signal (step 166). If "L+V Active" is not greater than the predetermined "L+V Active" time period, the controller 34 increases "L+V Active" (step 186) and proceeds to step 164.

The merchandise tag 20, including its housing 28, illustrated in the figures is one embodiment of a merchandise tag 20. The embodiments of controllers 34 described above may be used to control other merchandise tags with other housings of other suitable sizes, shapes, and structural configurations.

The order or sequence of any process or method steps may be varied or re-sequenced according to alternative embodiments.

In one embodiment, the controller 34 described above is a microprocessor. In other embodiments, the controller 34 may be any suitable type of controller. In one embodiment, the embodiments of methods described above may be implemented via hardware, firmware, software, or any other suitable implementation.

In one embodiment, a controller 34 for the merchandise tag 20 may have a predetermined light level of approximately 1.5 Lux (i.e., if the light level is below approximately 1.5 Lux, the merchandise tag 20 is considered to be in a low light environment indicative of potential theft). In another embodiment, the controller 34 for a merchandise tag may have a predetermined light level of approximately 1 Lux.

For purposes of this disclosure, motion detectors of embodiments of merchandise tags may be configured to detect at least one of vibration, motion relative to the earth, acceleration, etc. In various embodiments, detection of any of these may be "motion" as used in the embodiments of methods of controlling a merchandise tag described above.

In one embodiment, the motion sensor 36 of the merchandise tag 20 may be a piezoelectric sensor. In other embodiments, any suitable type of motion sensor 36 configured to detect any suitable type of motion with any suitable type of measurement may be used.

In one embodiment, the controller 34 is electrically coupled to the emitter 26, motion sensor 36, and light sensor 24. In one embodiment, the controller 34 is in operative communication with the emitter 26, motion sensor 36, and light sensor 24, but the controller 34 is not physically coupled to the emitter 26, motion sensor 36, and/or light sensor 24. In another embodiment, the controller 34 is coupled to the emitter 26, motion sensor 36, and light sensor 24 by electrical leads. For purposes of this disclosure, "coupled" includes mechanically coupled, electrically coupled, in operative communication, etc.

In the above embodiments of methods of control, while the controller 34 is described as keeping track of certain events and time periods in terms of counts (e.g., "VIB_COUNT" is described as the number of times that controller 34 determines that there has been vibration of the merchandise tag 20 within one second (step 88)) and time periods (e.g., "NO_VIB_TIME" is described as the amount of time that the has not been a vibration of the merchandise tag 20), in other embodiments, each count of events may be kept track of by the controller 34 as a time period. Additionally, in other embodiments, each time period may be kept track of by the controller 34 as a count of events. In some embodiments, controllers 34 may use counters, timers, or other suitable mechanisms.

In one embodiment, the controller 34 may control the emitter 26 to stop emitting a signal by not causing the emitter to emit a signal. In another embodiment, the controller 34 may signal the emitter 26 to control the emitter 26 to stop emitting a signal.

In one embodiment, when the controller 34 resets a time, e.g., "L+V Idle," "L+V Active," etc., the controller 34 sets the time, such as a time kept by a counter, to zero.

In one embodiment, a merchandise tag 20 is also configured to operate with an EAS system configured to sound an alarm when the merchandise tag 20 passes through an EAS gate. The EAS system may be a magnetic system, an acousto-magnetic system, a radio frequency system, a microwave system, a video surveillance system, or any other suitable type of system.

In one embodiment, when the power supply 38 of an embodiment of a merchandise tag 20 is low, e.g., below a predetermined level, the controller 34 will control the emitter 26 to emit a low battery signal.

In one embodiment, a merchandise tag 20 allows store personnel to identify the location of an item when hidden based on the signal emitted 26 by the emitter.

In one embodiment, the merchandise tag 20 may be configured to receive a signal sent from store personnel remote from the controller 34. Such a signal may be an infrared signal, visible light signal, RF signal (e.g., AM signal, FM signal, etc.), microwave signal, combinations thereof, or any other suitable type of signal. The controller 34 may be configured to control the emitter 26 to stop emitting a signal (e.g., an alarm signal, a warning signal, etc.) when it receives such a signal from store personnel.

In one embodiment, the emitter 26 is a speaker configured to emit audible signals. In another embodiment, the emitter 26 also includes a light emitter (e.g., LED, compact fluorescent light, etc.). In one embodiment, the emitter 26 is configured to emit a signal receivable by a monitoring station. In another embodiment, the emitter 26 is configured to emit an alarm signal and to emit ink, paint, indelible ink, indelible paint, or another flagging mechanism to flag the thief stealing the merchandise product 22.

For purposes of this disclosure, embodiments of merchandise tags 20 coupled to merchandise products 22 include coupling merchandise tags 20 to the merchandise products 22 themselves, the packaging of the merchandise products 22, etc. Additionally, merchandise tags 20 may be integrally formed with the merchandise products 22 themselves or the packaging of merchandise products 22.

The example of placing a merchandise product 22 in a pocket is merely exemplary. Conditions potentially indicative of theft that may be detected by embodiments of merchandise tags 20 exist in various other situations, e.g., merchandise products 22 being placed in bags, under clothing, etc.

In one embodiment the theft detection device 20 is a merchandise tag. In another embodiment, the theft detection device 20 is a wired alarm clip. In other embodiments, the theft detection device 20 may be any suitable theft detection mechanism.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A theft detection device configured to coupled to a product, comprising:

a light sensor;

a motion sensor;

an emitter configured to emit a signal; and a controller coupled to the light sensor, the motion sensor, and the emitter;

wherein the controller is configured to determine a light level sensed by the light sensor;

wherein the controller is configured to determine, via the motion sensor, whether the theft detection device is in motion;

wherein the controller is configured to operate the emitter based on the sensed motion of the theft detection device and the light level sensed by the light sensor;

wherein the controller is configured to deactivate the theft protection device when the light sensor detects a coded light sequence; and wherein the controller is configured to deactivate the theft protection device for a predetermined period of time when the light sensor detects the coded light sequence, the controller further configured to keep the theft protection device deactivated if the theft protection device is decoupled from the product during the predetermined period of time.

2. The theft detection device of claim 1, wherein the controller is configured to recognize strobe light sequences received by the light sensor.

3. The theft detection device of claim 2, further comprising a handheld strobe device for activating and deactivating the theft protection device.

4. The theft detection device of claim 1, wherein the controller is configured to re-activate the theft protection device if the theft protection device is subsequently coupled to a product.

5. The theft detection device of claim 1, wherein the controller is configured to re-activate the theft protection device if the theft protection device is not decoupled from the product.

6. The theft detection device of claim 1, wherein the controller is configured to recognize multiple coded light sequences for deactivation of the theft detection device.

7. The theft detection device of claim 1, wherein the controller is configured to enter the theft detection device into a sleep mode when no motion is detected for a predetermined period of time.

8. The theft detection device of claim 7, wherein the controller is configured to enter the theft detection device into the sleep mode when no motion is detected for 30 seconds.

9. The theft detection device of claim 7, wherein, after entering sleep mode, the controller is configured to exit the theft detection device from the sleep mode when the motion sensor detects motion for at least three consecutive seconds.

10. The theft detection device of claim 9, wherein, after exiting sleep mode, if the light sensed by the light sensor is below a threshold level, the controller is configured to cause the emitter to emit an alarm signal after a countdown period.

11. The theft detection device of claim 9, wherein, after exiting sleep mode, if no movement is detected for a predetermined time period, the controller enters theft detection device into the sleep mode.

12. The theft detection device of claim 1, wherein the controller is configured to wait for a predetermined period before causing the emitter to emit a signal if the light level sensed by the light sensor is below a threshold level, or if motion is detected by the motions sensor.

13. The method of claim 12, wherein the controller is configured to cause the emitter to emit a signal only for a set time period if the light level sensed by the light sensor is below the threshold level, or if motion is detected by the motions sensor.

14. The method of claim 12, wherein the predetermined period is between five and 30 seconds.

15. The method of claim 12, wherein the controller is configured to cause the emitter to emit a periodic warning signal during the predetermined time period before emitting an alarm signal.

* * * * *